US012239204B2

(12) United States Patent
Castex et al.

(10) Patent No.: US 12,239,204 B2
(45) Date of Patent: Mar. 4, 2025

(54) COSMETIC ARTICLE WITH RETRACTABLE APPLICATOR

(71) Applicant: CHANEL PARFUMS BEAUTE, Neuilly-sur-Seine (FR)

(72) Inventors: Nicolas Castex, Neuilly sur Seine (FR); Laurent Torriani, Bienne (CH); Antoine Bonadei, Bienne (CH); Carole Chapelat, Bienne (CH)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 0 days.

(21) Appl. No.: 18/268,837

(22) PCT Filed: Dec. 13, 2021

(86) PCT No.: PCT/FR2021/052286
§ 371 (c)(1),
(2) Date: Jun. 21, 2023

(87) PCT Pub. No.: WO2022/136764
PCT Pub. Date: Jun. 30, 2022

(65) Prior Publication Data

US 2024/0041179 A1 Feb. 8, 2024

(30) Foreign Application Priority Data

Dec. 22, 2020 (FR) ..... FR2013875

(51) Int. Cl.
*A46B 11/00* (2006.01)
*A45D 34/04* (2006.01)
*A45D 40/26* (2006.01)

(52) U.S. Cl.
CPC ..... *A45D 34/04* (2013.01); *A45D 40/262* (2013.01); *A45D 40/264* (2013.01);
(Continued)

(58) Field of Classification Search
CPC ..... A45D 40/262; A45D 40/264; A46B 2200/1053
(Continued)

(56) References Cited

U.S. PATENT DOCUMENTS 4,744,377 A 5/1988 Dolan, Jr.
6,371,129 B1 4/2002 Le Bras-Brown et al.
(Continued)

FOREIGN PATENT DOCUMENTS

FR 3 039 044 A1 1/2017
FR 3 039 045 A1 1/2017
(Continued)

OTHER PUBLICATIONS

International Search Report issued in International Patent Application No. PCT/FR2021/052286, dated Apr. 13, 2022, along with an English translation thereof.
(Continued)

*Primary Examiner* — Jennifer C Chiang
(74) *Attorney, Agent, or Firm* — GREENBLUM & BERNSTEIN, P.L.C.

(57) ABSTRACT

A cosmetic item including a reservoir adapted to contain a cosmetic product such as a mascara. A guide tube extends according to a longitudinal direction in the reservoir, and an applicator is mounted in longitudinal translation in the guide tube. The applicator can take on a retracted position and a deployed position with respect to the guide tube. The guide tube has a constant inner cross-section, and the applicator has a constant and identical cross-section, except for a functional clearance. The applicator includes a smooth longitudinal first portion and a second portion including a surface suitable adapted to retain the cosmetic product. The cosmetic item according to the invention is aesthetic and simple to use, it protects the cosmetic product from air and enables an accurate metering of the delivered product.

16 Claims, 3 Drawing Sheets

(52) U.S. Cl.
CPC ..... *A45D 2200/05* (2013.01); *A45D 2200/10* (2013.01); *A46B 2200/1053* (2013.01)

(58) Field of Classification Search
USPC ..... 401/109, 127
See application file for complete search history.

(56) References Cited

U.S. PATENT DOCUMENTS

| | | | | |
|---|---|---|---|---|
| 8,944,712 | B2 * | 2/2015 | Thorpe | A46B 11/00 132/218 |
| 10,548,394 | B2 * | 2/2020 | Castex | A45D 34/042 |
| 2018/0206615 | A1 | 7/2018 | Castex et al. | |
| 2018/0206625 | A1 | 7/2018 | Castex et al. | |
| 2018/0213924 | A1 | 8/2018 | Castex et al. | |

FOREIGN PATENT DOCUMENTS

| | | | |
|---|---|---|---|
| FR | 3 039 046 | A1 | 1/2017 |
| JP | S5588704 | | 6/1980 |
| JP | 2017-113163 | A | 6/2017 |

OTHER PUBLICATIONS

Written Opinion of the International Searching Authority issued in International Patent Application No. PCT/FR2021/052286, dated Apr. 13, 2022.

* cited by examiner

COSMETIC ARTICLE WITH RETRACTABLE APPLICATOR

BACKGROUND

1. Field of the Invention

The present invention relates to the field of cosmetic product applicators, and in particular applicators for mascara.

2. Description of the Background

A mascara item, or "mascara", conventionally comprises a case, a mascara reservoir and an applicator brush. The applicator brush includes a gripping portion and an applicator strictly speaking, which is generally in the form of a brush. The applicator brush may include, in a known manner, a cap or plug adapted to seal the reservoir when the mascara is not being applied and which may form the gripping area of the applicator brush.

There are conventionally several types of applicators: the "brush" type ones, the injected ones and those manufactured by additive manufacturing (sometimes called "additive synthesis"). Additive manufacturing refers to manufacturing processes by adding or aggregating matter.

An applicator of the bottle brush type includes a brush that comprises bristles formed by fibres trapped in a twisted metal wire forming the core of the applicator. An injected applicator is generally formed integrally in one-piece and includes bristles or teeth, made of a plastic material for example, generally called protuberances. An applicator manufactured by additive manufacturing is also generally made integrally in one-piece and may be formed, for example, from a powder of thermoplastic polymers via a process implementing, for example, powder fusion by laser.

Regardless of the shape and embodiment of a known mascara applicator, the principle of applying mascara consists in loading the applicator with product (mascara) contained in the reservoir, in extracting from said reservoir the applicator whose protuberances are loaded with product, and in carrying out the application on the eyelashes or the eyebrows of the user.

For simplicity, in the rest of the present document only the eyelashes are mentioned, yet without excluding a use of the product and of the applicator on the eyebrows of the user. Similarly, a female user is mentioned, yet without excluding a use by a male user. In order to improve the ergonomics of mascara items, the document US 2010/0065080 discloses an item for the application of mascara having a retractable configuration, of the "pen" type. It comprises an elongated case and an applicator slidably mounted relative to the case so as to occupy a stowed position in which it is immersed in the mascara reservoir and an extended position in which it enables make-up. An advantage of this configuration is that it enables using the item with one hand for make-up, in comparison with current items in which the brush is mounted on the plug and the latter is screwed onto the reservoir so that the user must use both hands to unscrew the plug and access the brush. Yet, knowing that the applicator is immersed in the product of the reservoir in the stowed position, it comes out of the case loaded with a large amount of product, a large portion of which is not used for make-up, in particular that portion in the vicinity of the core of the applicator. In addition, this product being in contact with the air, this promotes drying thereof, which reduces the service life of the item. This immersion into the reservoir poses another problem, namely the entry of air into the reservoir which also promotes drying and limits the service life of the product in the reservoir.

Thus, with the mascara applicators known in the prior art, more product is generally drawn than is necessary for the make-up, or more than the amount that could actually be applied on the eyelashes. The drawn excess product is then plunged back into the reservoir. This is repeated each time the applicator is used. In addition, with the mascara items known in the prior art, while the user applies the product, the mascara reservoir remains open and the product is exposed to the open air for the application time. This might cause a premature drying of the product. Thus, the quality of the mascara might be altered, which might result in the presence of lumps or less fluidity of the product. The documents FR3039044, FR3039045 and FR3039046 provide a partial solution to the aforementioned problems, by proposing a mascara item including an applicator movable relative to its case, between a stowed position and an extended position, the applicator comprising a body and protuberances (bristles or teeth) mounted movable relative to the body of the applicator between a retracted position in said body and an extended position outside said body. According to some provisions provided for in these documents, the applicator may be loaded with product when it comes out of the case. Nevertheless, these devices could still be improved, as they are complex and as they do not guarantee a perfect regularity of the delivered product dose. In particular, the applicator is frequently loaded with a dose of cosmetic product larger than that actually applied, which poses a problem of preservation of the product brought onto the applicator but not applied. Furthermore, they could still be improved for the delivery and preservation of air-sensitive, for example highly volatile, mascara formulas.

Finally, there is a permanent need to develop aesthetic and qualitative mascara items. The invention aims to provide a mascara item which addresses all or part of the aforementioned problems.

SUMMARY

Thus, the invention relates to a cosmetic item including a reservoir adapted to contain a liquid or semi-liquid cosmetic product, a guide tube extending according to a longitudinal direction in said reservoir, and an applicator mounted movable in longitudinal translation in said guide tube between a retracted position in which the applicator is entirely or partially contained in the guide tube and a deployed position in which a portion of the applicator which is contained in the guide tube in the retracted position has come out of one end of the guide tube.

The applicator includes a smooth longitudinal first portion, and a second portion having a surface adapted to retain said cosmetic product. The guide tube has a constant inner cross-section, and the first portion of the applicator has a constant and identical cross-section, except for a functional clearance, to the cross-section of the guide tube.

The guide tube includes, proximate to said end, at least one aperture enabling the passage of the cosmetic product from the reservoir towards the applicator.

The cosmetic item proposed in the invention, for example the mascara item, is simple and aesthetic. The applicator has an innovative shape. The second portion of the applicator, which has a pattern enabling the retention of product, forms the portion of the applicator that enables the application of the cosmetic product, for example on the eyelashes of the user. Also, the use of a "textured" area, featuring a pattern for retaining the product, allows calibrating very accurately and in a perfectly repeatable manner the amount of product loaded on this second portion of the applicator. This allows accurately adjusting the amount of product delivered each time the applicator switches from its retracted position into its deployed position. The shape correspondence between the applicator and the guide tube, except for a small functional clearance enabling sliding of the applicator in the tube, ensures sealing with respect to the product. It also ensures protection of the product from air, only the product present on the second portion of the applicator being exposed thereto when the applicator is deployed, i.e. just before the product is applied. The product present in the reservoir remains protected from air at all times. This allows considerably increasing service life compared to a conventional cosmetic item.

The second portion of the applicator may entirely or partially face the aperture, in the retracted position.

The aperture present in the tube enables loading of the applicator with cosmetic product, at its second portion. This configuration for loading the applicator with product is particularly advantageous in that it enables the use of viscous products, and/or products whose ageing has led to an increase in viscosity. Indeed, the longitudinal translational movement of the applicator relative to the aperture generates shear forces in the product, at this aperture, which locally fluidises it when loading the applicator.

The second portion may have at its surface a pattern including for example recesses and/or ridges.

The selection of the characteristics of the pattern, its shape, its depth, allows selecting the amount of product retained at the surface of the second portion of the applicator. This allows for an extremely accurate metering of the product. The selection of the pattern also allows modulating the shear forces created when loading the applicator with product. Finally, the pattern also determines the properties of the applicator when applying the product, in particular its ability to stick to and separate from the eyelashes (or other hairs).

The applicator may be metallic. The applicator may be made of a plastic material.

A metallic applicator (and more generally an item) is aesthetic, durable, and can be obtained with very low manufacturing tolerances, allowing for a perfect sealing of the system. An applicator made of a plastic (including composite) material can be obtained at low cost.

The surface of the second portion may be made of a porous material, for example a ceramic or a foam.

A porous material is a relevant solution for retaining the product as an alternative to the formation of a pattern.

In particular, the applicator may have a straight prismatic general shape, or an axisymmetric cylindrical shape.

The selection of the section of the applicator, and correspondingly of the guide tube, is important from a functional point of view and from an aesthetic point of view. Although an axisymmetric cylindrical shape (circular cross-section) is the simplest and best configuration to guarantee sealing between the applicator and the guide tube, any straight prismatic shape (the applicator having for example a polygonal cross-section), which therefore enables the translation of the applicator in the guide tube may be considered in the invention. The functional clearance may be comprised between 0.2 microns and 100 microns.

This enables a regular loading of the applicator with product, throughout the duration of use thereof.

The reservoir may include a device for pressurising the product contained therein.

For example, the pressurising device may include a plunger pushed by an elastic device.

The cosmetic item may include a first return device which tends to bring and hold the applicator in the deployed position. The first return device allows bringing and holding the item in the position enabling the application of the product. The cosmetic item may include a sleeve in which the reservoir is formed, the reservoir being mounted movable in longitudinal translation in the sleeve between a stowed position and an extended position.

The cosmetic item may include a second return device interposed between the reservoir and the sleeve and which tends to bring the reservoir back into the stowed position. The cosmetic item may be configured so that the reservoir being brought into the extended position, the applicator remains fixed with respect to the sleeve so that it is brought into the retracted position with respect to the reservoir.

According to one embodiment, the applicator is in the retracted position when the reservoir is in the extended position and the applicator is in the deployed position when the reservoir is in the stowed position.

These configurations enable the relative movement between the applicator and the reservoir, allowing loading the applicator with product.

The cosmetic item may include a removable cap, the set-up of the cap on the cosmetic item pressing on the applicator to bring it into the retracted position.

Thus, a cap may be used to press on the applicator to retract it relative to the reservoir, in a very simple configuration of the cosmetic item. The cap enhances sealing of the device.

The reservoir may be mounted removable from the sleeve.

Thus, the device is durable. The reservoir may, where appropriate, be filled again. Other particularities and advantages of the invention will appear further in the description hereinafter.

BRIEF DESCRIPTION OF THE DRAWING

In the appended drawings, given by way of non-limiting examples.

DETAILED DESCRIPTION

Figure 1:
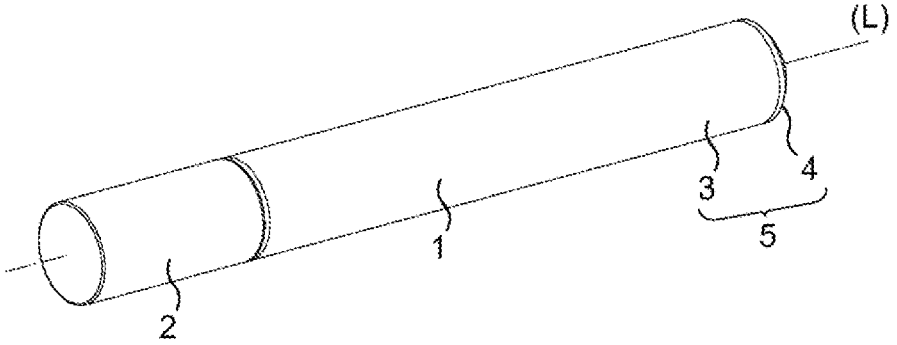
FIG. 1 represents, according to a schematic view in three dimensions, a cosmetic item in accordance with an embodiment of the invention.

FIG. 1 represents, according to a schematic three-dimensional view, a cosmetic item in accordance with one embodiment of the invention. According to the represented embodiment, the item has an oblong shape similar to that of a pen. Thus, the item includes a main body 1, at one end of which a cap 2 is attached or abutted. The main body externally includes a barrel 3 sealed by a plug 4, the barrel 3 and the plug 4 forming a sleeve 5. The item extends according to a general direction of extension called longitudinal direction L.

Figure 2:
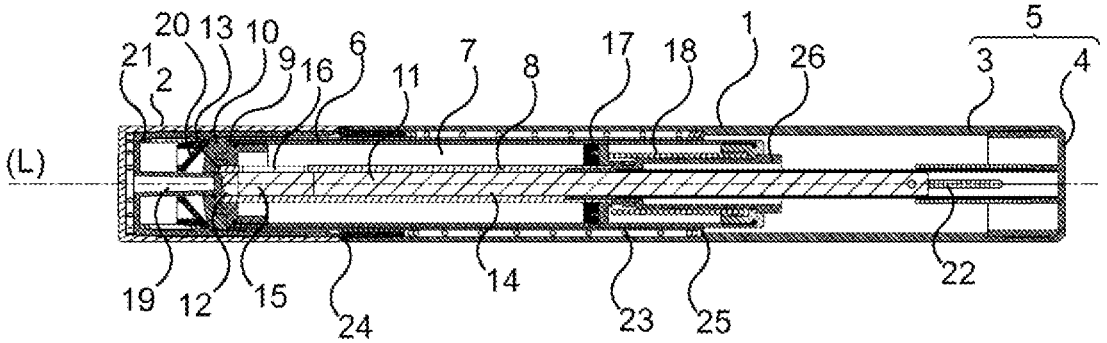
FIG. 2 represents, according to a schematic sectional view, the cosmetic item of FIG. 1 when stored.

FIG. 2 represents, according to a schematic sectional view, the cosmetic item of FIG. 1 when stored. The cosmetic item includes a reservoir 6 adapted to contain a cosmetic product. The cosmetic product, for example a mascara, may be in a liquid or semi-liquid, including pasty, form. The cosmetic product may include solid particles, for example flakes, fibres, etc., included in a liquid or a paste. The reservoir 6 has the general shape of a cylinder. It extends according to the longitudinal direction L. The reservoir 6 accommodates an internal volume 7 adapted to receive the cosmetic product.

The reservoir 6 is formed in the sleeve 5 of the main body 1 of the cosmetic item.

The reservoir 6 is crossed longitudinally by a guide tube 8. In particular, the guide tube 8 may be centred with respect to the reservoir, and thus be positioned on a central longitudinal axis of the reservoir and more generally of the cosmetic item. In the represented example, the guide tube 8 extends over the entire length of the internal volume 7 of the reservoir 6.

The guide tube 8 has a constant cross-section (i.e., considered according to a plane perpendicular to the longitudinal direction L). It may be circular, but any other constant cross-section may be considered, in particular any oval or polygonal section. One end of the reservoir 6 is sealed by an endpiece 9, which forms sealing with the inner walls of the reservoir 6 on the one hand, and with the outer walls of the guide tube 8 on the other hand. Thus, the internal volume 7 of the reservoir 6 is tightly closed at this end of the reservoir 6. The endpiece 9 may carry a finishing dome 10, which is connected thereto. The finishing dome 10 has an aesthetic function. It may also contribute to sealing the device as explained hereinafter.

The cosmetic item also includes an applicator 11. The applicator 11 corresponds to the portion of the item thanks to which the user can apply the cosmetic product, for example on his/her eyelashes.

The applicator 11 is mounted movable in longitudinal translation in the guide tube 8. Optionally, the applicator may also be movable in rotation in the guide tube, when said applicator has an axisymmetric cylindrical general shape.

In particular, the cosmetic item is configured so that the applicator 11 can take on a retracted position and a deployed position. Between the retracted position and the deployed position, and vice versa, the applicator 11 and the reservoir 6 thus have a relative translational movement or a combined relative translational and rotational movement.

Figure 3:
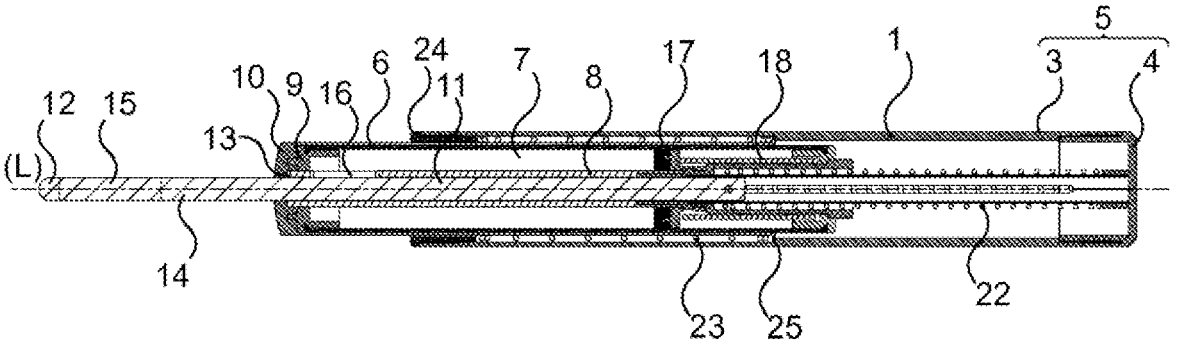
FIG. 3 represents, according to a schematic sectional view, the cosmetic item of FIGS. 1 and 2, when used.

The applicator is represented in the retracted position in FIG. 2, and in the deployed position in FIG. 3.

In the retracted position, the applicator 11 is contained, entirely or partially, in the guide tube 8. In the embodiment represented herein, the applicator 11 in the retracted position, has a tip 12 which is contained in the guide tube 8. In the deployed position, the applicator 11 comes more out of the guide tube 5 than it is in the retracted position. In other words, a portion of the applicator which is contained in the guide tube in the retracted position comes out of one end 13 of the guide tube 8 in the deployed position of the applicator 11.

In order to enable the translation of the applicator 11 in the guide tube 8, the applicator 11 has a corresponding cross-section, except for some clearance, to the inner cross-section of the guide tube 8. Thus, the applicator 11 has a right prism or an axisymmetric cylinder shape.

The clearance between the applicator 11 and the inner walls of the guide tube 8 is extremely small, it is intended only to avoid a tight fitting of the applicator 11 in the guide tube 8. The manufacturing tolerance is also low enough to guarantee sealing allowing avoiding a flow of the cosmetic product between the guide tube 8 and the applicator. Thus, this tolerance is advantageously comprised between 0.2 μm and 0.1 μm. Thus, the cosmetic product cannot spread or escape between the guide tube 8 and the applicator 11.

Advantageously, the applicator 11 is made in one-piece. In particular, it may be made of metal, for example of stainless steel, of aluminium, or of an aluminium alloy. Alternatively, it may be made of a plastic material, in particular of a reinforced plastic material or of a composite material, or of a porous material such as a ceramic or a foam. The applicator 11 includes a smooth longitudinal first portion 14, and a second portion 15 including a surface adapted to retain said cosmetic product. For this purpose, patterns are formed over the second portion 15 and form slight recesses at its surface, which fill with liquid and are retained therein. Retention is obtained thanks to the surface tension of the cosmetic product.

The patterns, formed at the surface of the applicator 11 are made in the external general envelope of the applicator. Thus, the applicator 11 has a general shape which corresponds, except for a functional clearance, to the (internal) general shape of the guide tube 8. Thus, while the first portion of the applicator, which has no pattern, ensures sealing against the flow of the product between the applicator and the reservoir, the second portion which includes patterns does not prevent the relative translation (and where appropriate the relative rotation) between the applicator 11 and the reservoir 8. As an alternative to making patterns to retain the product, the second portion may be made of a porous material or covered at its surface with a porous material.

Some ceramics or some foams (natural, plastic, metallic . . . ) may be used for this purpose.

Figure 4:
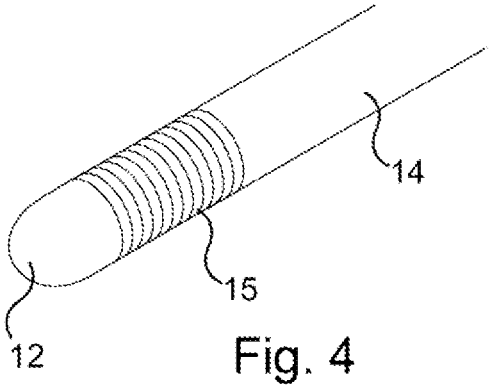
FIG. 4 represents, according to a schematic three-dimensional view, an example of an end portion of an applicator that can be used in the invention.

FIG. 4 shows, according to a schematic three-dimensional view, an example of an end portion of an applicator 11 that can be used in the invention. FIG. 4 shows an example of a second portion 15, made proximate to the tip 12 of the applicator 11, and followed by the first portion 14 whose surface is smooth.

In the example of FIG. 4, the second portion has patterns, namely ridges. Other shapes of patterns may be formed at the surface of the second portion 15, and even, where necessary, several different patterns.

In particular, the surface condition of the second portion 15 may be obtained by knurling the applicator over this second portion.

The guide tube 8 includes, proximate to its end 13, an aperture 16. The aperture 16 is an opening formed in the wall of guide tube 8. Thus, the aperture 16 enables the switch of the cosmetic product contained in the reservoir 6 towards the inside of the guide tube 8. The aperture 16 may have an oblong shape. In particular, the aperture 16 may have a length (dimension in the longitudinal direction L) close or equivalent to the length of the second portion 15 of the applicator.

The aperture 16 allows loading the second portion 15 with cosmetic product. This loading is performed when the second portion 15 faces the aperture 16. Several apertures 16 may be distributed at the periphery of the guide tube 8, in order to improve the distribution of the cosmetic product at the periphery of the second portion 15 of the applicator 11.

In order to enable loading of the applicator with cosmetic product regardless of the orientation of the cosmetic item, the cosmetic product is pressurised in the reservoir 6, which tends to expel the cosmetic product through the aperture 16.

This pressurisation may be achieved by various means. The preferred pressurising device illustrated herein includes a plunger 17 which is movable in longitudinal translation in the reservoir 6. The plunger 17 is pushed in the direction of the end of the reservoir 6 by an elastic device. A first compression spring 18, in particular a helical spring, may be used as an elastic device. Alternatively, a compressed gas elastic device may be used. Any other suitable elastic device may be considered.

Besides the possibility of loading the applicator in all orientations of the mascara item, the plunger (or any similar pressurising device) also enables the internal volume 7 of the reservoir to adapt permanently to the amount of product present in the reservoir. Thus, the product is never in contact with air, which might degrade it.

The second portion 15 may entirely or partially face the aperture 16 when the applicator is in the retracted position (as represented in FIG. 2). This enables loading of the second portion 15 with cosmetic product. If not all of the second portion faces the aperture 16 in the retracted position, the applicator is configured so that the entirety of the second portion 15 scrolls opposite the aperture 16 when switching from the retracted position into the deployed position, and/or when switching from the deployed position into the retracted position.

The relative movement between the applicator 11 and the guide tube 8 also creates shear forces in the cosmetic product, which fluidises it locally and enables loading thereof more easily on the applicator 11.

FIG. 3 represents the cosmetic item of FIG. 2 with the applicator 11 in the deployed position. The switch from the retracted position into the deployed position is done, in the represented embodiment, as follows.

The cap 2 is removed from the cosmetic item. For this purpose, it is detached from the main body 1. In particular, the cap 2 may be a screw cap, or a clipped cap. The cap may be held in position by a magnetic system. It may be connected to the sleeve 5 or to the reservoir 6.

The cap 2 may include a central pin 19 inserted into a central orifice of the finishing dome 10 when the cap 2 is in place on the main body 1. This guarantees perfect sealing to the cosmetic item. Furthermore, the central pin 19 presses on the end 12 of the applicator 11, which keeps it in the retracted position. The cap 2 may also include an inner ring 20 which bears on the finishing dome 10 and which is constrained against the latter by an elastic means, for example a second compression spring 21. The inner ring 20 and its elastic means allow making sealing of the device perfect, they facilitate the removal of the cap 2, and, by pushing back the cap if it is not properly closed (and for example locked), allow alerting the user on an improper closure of the cap.

When the cap 2 is removed from the cosmetic item, the applicator 11 is pushed into the deployed position. Indeed, the cosmetic item includes a first return device 22 which tends to bring and hold the applicator in the deployed position. When the cap 2 is removed, it no longer retains the applicator in the retracted position by bearing on its tip 12. The first return device 22 may include a compression spring, which is interposed between the applicator 11 and the main body 1, in this case between the applicator 11 and the plug 4. The reservoir 6 being formed in the sleeve 5, the first return device 22 tends to make the applicator 11 come out through the end 13 of the guide tube. Thus, the relief of the first return means brings the applicator into the deployed position.

The reservoir 6 is mounted movable in longitudinal translation, and where appropriate in rotation, in the sleeve 5. The reservoir may take on a stowed position and an extended position, with respect to the sleeve 5. Between the extended position and the stowed position, and vice versa, the reservoir 6 and the sleeve 5 thus have a relative translational movement or a combined relative translational and rotational movement. Both in its stowed position and in its extended position, reservoir 6 is partially formed in the sleeve 5; the reservoir however comes more out of the sleeve 5 in the extended position than it is in the stowed position.

Figure 5:
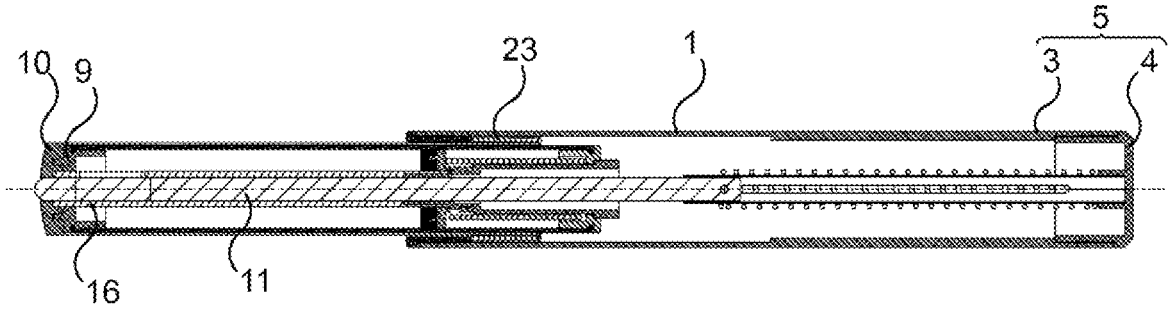
FIG. 5 represents, according to a schematic sectional view, the cosmetic item of FIGS. 1 to 3, when reloading the applicator between two successive applications.

FIG. 3 represents the reservoir in the retracted position. FIG. 5, which is detailed hereinafter, represents the reservoir 6 in the extended position.

In the represented embodiment, the cosmetic item includes a second return device 23, which tends to bring the reservoir back into the stowed position. For this purpose, the second return device 23, which may include a compression spring, is interposed between the reservoir 6 and the sleeve 5 (and more particularly between an endpiece 24 of the sleeve 5 and a stop 25 of the reservoir 6).

FIG. 5 represents the reservoir 6 in the extended position. In this position, the second return device 23 is compressed. For example, the reservoir is brought into the extended position under the effect of a pull exerted by the user on the reservoir 6, in the longitudinal direction L.

When the reservoir 6 is brought into the extended position, the applicator 11 remains fixed with respect to the sleeve 5 because the first return device 22 is relieved and the applicator is in abutment. Thus, the movement of the reservoir 6 towards its extended position creates a relative movement between the reservoir 6 and the applicator 11 which brings the applicator 11 into the retracted position with respect to the reservoir 6. Thus, bringing the reservoir 6 into the extended position allows reloading the second portion 15 of the applicator with cosmetic product by bringing the aperture of the guide tube 8 (which is fixed with respect to the reservoir 6) opposite this second portion 15. This allows reloading the applicator easily during the same sequence of application of the cosmetic product (for example between making up the eyelashes of each eye of the user), without having to put the cap 2.

In the represented example, each of the applicator 11 and the reservoir 6 is subjected to a respective return device, so that in the absence of a cap 2 and in the absence of an external stress exerted on the cosmetic item, the applicator 11 takes on its deployed position and the reservoir its stowed position. The movement of the applicator and that of the reservoir is performed by applying thereon a force contrary to the biasing force applied by the respective return device.

Other configurations, in particular other mechanisms, may be considered to cause the switch of the applicator from its retracted position into its deployed position and vice versa, and/or the switch of the reservoir from its stowed position into its extended position and vice versa. For example, gear mechanisms, in particular of the rack type, may be successfully used. According to some configurations of the invention, the cap 2 is thus optional.

Advantageously, the reservoir 6 is removable from the sleeve 5. The reservoir 6 can be extracted from the sleeve 5 in order to be replaced with a full reservoir, so that it consists of a replaceable, and even consumable, element. Alternatively, the reservoir 6 can be extracted from the sleeve 5 in order to be filled again. These two possibilities can be combined, i.e. the reservoir may be extracted to be replaced by a full reservoir, whereas the empty reservoir is sent to a filling line for subsequent use.

Figure 6:
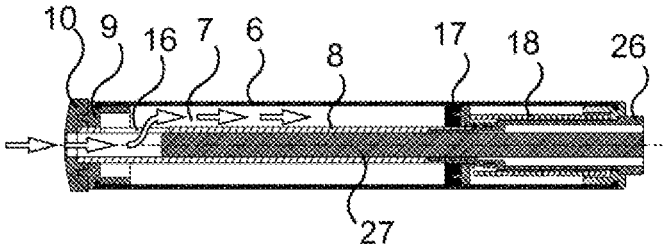
FIG. 6 represents, according to a schematic sectional view, the reservoir of the cosmetic item of FIGS. 1 to 3 and FIG. 5, in a configuration enabling filling thereof with cosmetic product.

The removal of the reservoir 6 is performed by removing the endpiece 24 from the sleeve 5, which releases the spring of the second return device 23 as well as the stop 25 of the reservoir 6. FIG. 6 represents, according to a schematic sectional view, the reservoir of the cosmetic item of FIGS. 1 to 3 and of FIG. 5, in a configuration enabling reloading thereof with cosmetic product.

In the configuration of FIG. 6, the plunger 17 is pushed back to the bottom of the reservoir, thereby releasing all of the available internal volume 7. The plunger 17 may be blocked in this position by a locking system present on the plunger support 26.

A filling stick 27 is placed in the guide tube 8. The filling stick is configured to form sealing from the guide tube 8. Nevertheless, the filling stick 27 extends only up to the level of the aperture 16 of the guide tube 8, and does not obstruct this aperture. The reservoir can then be filled through the central orifice of the finishing dome 10, and therefore through the end 13 of the guide tube 8. The flow of the cosmetic product during filling of the reservoir is represented in FIG. 6 by dotted arrows.

Figure 7:
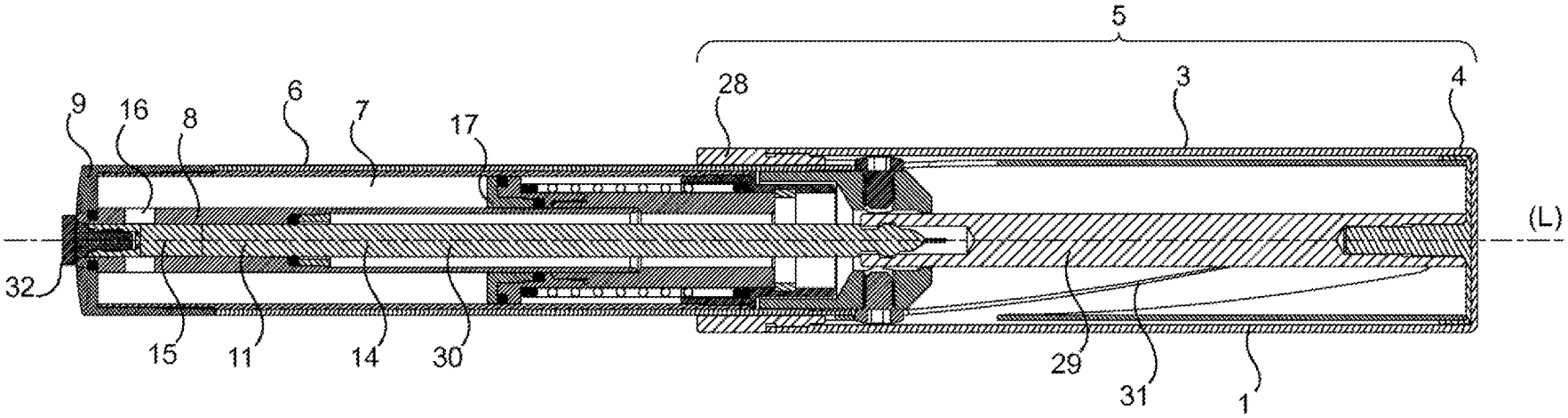
FIG. 7 represents, according to a schematic sectional view, a cosmetic item in accordance with a second embodiment of the invention, when stored.
Figure 8:
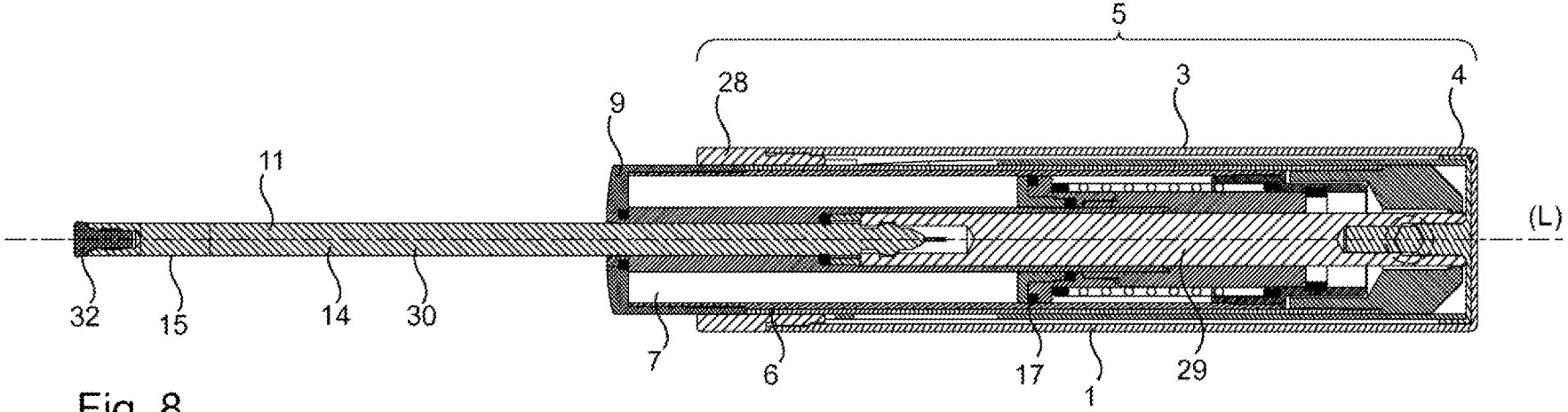
FIG. 8 represents, according to a schematic sectional view, the cosmetic item of FIG. 7 when used.

FIG. 7 represents, according to a schematic sectional view, a cosmetic item in accordance with a second embodiment of the invention, when stored. FIG. 8 represents, according to a schematic sectional view, the cosmetic item of FIG. 7 when used.

The embodiment of FIGS. 7 and 8 differs from the embodiment of FIGS. 1 to 6 essentially in that the applicator 11 is retractable through a relative movement with respect to the reservoir 6, but fixed with respect to the body main 1.

Hence, for this embodiment, it is generally possible to refer to the description of the embodiment of FIGS. 1 to 6, except for the differences that are detailed hereinafter.

Just like in the previously-described embodiment, the item thus includes a main body 1, at one end of which a cap is attached or abutted, which is optional, and which is not represented in FIG. 7.

The main body 1 includes in the represented embodiment a main ring 28 on which a plug 4 is fastened, said main ring 28 and the plug 4 together forming a barrel 3 forming a sleeve 5.

The item extends according to the longitudinal direction L.

The cosmetic item includes a reservoir 6, forming an internal volume 7, adapted to contain a cosmetic product and which has the general shape of a cylinder.

One end of the reservoir 6 is sealed by an endpiece 9, which forms sealing with the inner walls of the reservoir 6. The endpiece contributes to sealing of the device as explained hereinafter.

The reservoir 6 is crossed longitudinally by the guide tube 8. In particular, the guide tube 8 extends over an end portion of the reservoir 6. The cosmetic item also includes an applicator 11.

The applicator 11 is mounted movable in longitudinal translation relative to the guide tube 8. In the present embodiment, the applicator 11 is mounted fixed relative to the main body 1. In the represented example, the applicator 11 is formed into two portions, namely a first applicator portion 29, which extends into the main body 1 in the longitudinal direction L, and a second applicator portion 30 fixed in line with the first applicator portion 29. The second applicator portion 30 extends beyond the end of the main body 11 opposite to the plug 4. The first applicator portion 29 and the second applicator portion 30 may be made of the same material, typically the same metal, or of different materials. Such a construction into two portions enables a separation of the applicator in two to facilitate reloading of the reservoir with cosmetic products. The second applicator portion 30 (just like the applicator 11 of the embodiment of FIGS. 1 to 6) includes a smooth longitudinal first portion 14 and a second portion 15 including a surface adapted to retain said cosmetic product.

In turn, the reservoir 8 is mounted movable in translation relative to the main body. More specifically, in the represented example, the reservoir 6 is movable according to a combined translational and rotational movement relative to the main body 1. Of course, a pure translational movement, with no combined rotation, may be considered. This combined movement, which corresponds to a natural gesture for the user of the cosmetic item, may be guided using a helical ramp 31 formed in the main body (herein over an inner surface of the plug 4). Hence, in this embodiment, the reservoir 6 and the guide tube 8 are also movable in rotation around the applicator 11.

Hence, the reservoir 6 can take on an extended position with respect to the main body 1 in which a portion of the reservoir is not contained in the main body, and a stowed position in the main body in which a larger portion of the reservoir is contained in the main body than in its extended position.

The cosmetic item is configured so that the applicator 11 takes on a retracted position when the reservoir is in the extended position (as represented in FIG. 7). In this retracted position, the applicator is retracted into the cosmetic item in that it is entirely included (with the possible exception of the tip 12) in the volume of the reservoir 6 and of the main body 1. In particular, the tip 12 of the applicator may be equipped with an insert 32 ensuring good sealing with the endpiece 9 of the reservoir 6.

When the reservoir 6 is brought into its retracted position in the main body 1, the applicator takes on its deployed position, represented in FIG. 8, in that it has partially come out of the guide tube 8 and of the reservoir 6, in a position enabling the application of the cosmetic product present on the second portion 15 of the applicator 11.

Loading of the second portion 15 of the applicator 11 with cosmetic product is done just like the embodiment of FIGS. 1 to 6, through one or more opening(s) 16 formed in the wall of the guide tube 8. Depending on the position and the shape of the aperture(s) 16, this loading may be carried out when the applicator is in the retracted position and/or upon a passage of the second portion 15 of the applicator 11 opposite the aperture 16 when the reservoir is brought into the stowed position, which places the applicator in the deployed position.

A device for pressurising the cosmetic product similar to the previously-described one may be used, for example including a plunger 17 pushed by an elastic device such as a compression spring.

The invention so developed allows obtaining a cosmetic item, preferably for the delivery of a mascara, which is aesthetic and easy to use. The product contained therein is particularly well protected from air in the reservoir of the cosmetic item. Thanks to the use of an applicator with a constant section, for example metallic, having a portion whose surface includes a pattern, a very accurate metering of the amount of product delivered on the applicator is obtained. The method for loading this portion of the applicator is compatible with viscous and even pasty products, thanks to the generation of shear stresses in the product during the relative movement between the applicator and the reservoir.

The invention claimed is:

1. A cosmetic item comprising:

a reservoir configured to contain a liquid or semi-liquid cosmetic product;

a guide tube extending according to a longitudinal direction in the reservoir; and an applicator movably mounted in longitudinal translation in the guide tube between a retracted position in which the applicator is contained entirely or partially in the guide tube and a deployed position in which a portion of the applicator which is contained in the guide tube in the retracted position comes out from one end of the guide tube;

the applicator including a smooth longitudinal first portion, and a second portion having a surface configured to retain the cosmetic product;

the guide tube having a constant inner cross-section;

the first portion of the applicator having a constant and identical cross-section, except for a functional clearance, to the cross-section of the guide tube; and the guide tube including, proximate to the end, at least one aperture enabling the passage of the cosmetic product from the reservoir towards the applicator; the second portion of the applicator entirely or partially faces the aperture in the retracted position.

2. The cosmetic item according to claim 1, wherein:

the second portion has a pattern at its surface, the pattern including recesses and/or ridges.

3. The cosmetic item according to claim 1, wherein:

the applicator is metallic.

4. The cosmetic item according to claim 1, wherein:

the applicator is made of a plastic material.

5. The cosmetic item according to claim 1, wherein:

at least the surface of the second portion consists of a porous material.

6. The cosmetic item according to claim 1, wherein:

at least the surface of the second portion consists of a ceramic or a foam.

7. The cosmetic item according to claim 1, wherein:

the applicator has a straight prismatic general shape, or an axisymmetric cylindrical shape.

8. The cosmetic item according to claim 1, wherein:

the functional clearance is comprised between 0.2 microns and 100 microns.

9. The cosmetic item according to claim 1, wherein:

the reservoir includes a pressurizer configured to pressurize the product contained in the reservoir.

10. The cosmetic item according to claim 1, wherein:

the reservoir includes a pressurizer configured to pressurize the product contained in the reservoir, the pressurizer comprising a plunger pushed by an elastic.

11. The cosmetic item according to claim 1, further comprising:

a first return device which tends to bring and hold the applicator in the deployed position.

12. A cosmetic item comprising:

a reservoir configured to contain a liquid or semi-liquid cosmetic product;

a guide tube extending according to a longitudinal direction in the reservoir; and an applicator movably mounted in longitudinal translation in the guide tube between a retracted position in which the applicator is contained entirely or partially in the guide tube and a deployed position in which a portion of the applicator which is contained in the guide tube in the retracted position comes out from one end of the guide tube;

the applicator including a smooth longitudinal first portion, and a second portion having a surface configured to retain the cosmetic product;

the guide tube having a constant inner cross-section;

the first portion of the applicator having a constant and identical cross-section, except for a functional clearance, to the cross-section of the guide tube; and the guide tube including, proximate to the end, at least one aperture enabling the passage of the cosmetic product from the reservoir towards the applicator;

a sleeve within which the reservoir is formed, the reservoir being movably mounted in longitudinal translation in the sleeve between a stowed position and an extended position.

13. The cosmetic item according to claim 1, further comprising:

a second return device interposed between the reservoir and the sleeve and which tends to bring the reservoir back to the stowed position and wherein the applicator being in the deployed position, the reservoir can be brought into the extended position by translation in the longitudinal direction, the applicator being in abutment and fixed with respect to the sleeve, so as to cause a relative movement between the reservoir and the applicator which brings the applicator into the retracted position with respect to the reservoir.

14. The cosmetic item according to claim 12, wherein:

the applicator is in the retracted position when the reservoir is in the extended position; and the applicator is in the deployed position when the reservoir is in the stowed position.

15. The cosmetic item according to claim 1, further comprising:

a removable cap, the set-up of the cap on the cosmetic item pressing on the applicator to bring it into the retracted position.

16. The cosmetic item according to claim 1, wherein:

the reservoir is removably mounted with respect to the sleeve.

* * * * *